US011539157B2

(12) United States Patent
Harwood et al.

(10) Patent No.: US 11,539,157 B2
(45) Date of Patent: Dec. 27, 2022

(54) CONNECTION ASSEMBLY FOR AUDIO EQUIPMENT

(71) Applicant: Shure Acquisition Holdings, Inc., Niles, IL (US)

(72) Inventors: Walter Timothy Harwood, Streamwood, IL (US); Weiqiang Kang, Suzhou (CN); Feng Wang, Wuxi (CN); Shun Guo, Suzhou (CN)

(73) Assignee: Shure Acquisition Holdings, Inc., Niles, IL (US)

( * ) Notice: Subject to any disclaimer, the term of this patent is extended or adjusted under 35 U.S.C. 154(b) by 87 days.

(21) Appl. No.: 16/987,912

(22) Filed: Aug. 7, 2020

(65) Prior Publication Data

US 2021/0091505 A1 Mar. 25, 2021

Related U.S. Application Data

(63) Continuation of application No. 16/058,444, filed on Aug. 8, 2018, now Pat. No. 10,749,287.

(51) Int. Cl.

| | |
|---|---|
| ***H01R 13/516*** | (2006.01) |
| ***H01R 13/512*** | (2006.01) |
| ***H01R 13/627*** | (2006.01) |
| ***H01R 13/66*** | (2006.01) |
| ***H04R 1/04*** | (2006.01) |

(52) U.S. Cl.

CPC ..... *H01R 13/516* (2013.01); *H01R 13/512* (2013.01); *H01R 13/6272* (2013.01); *H01R 13/665* (2013.01); *H01R 13/6691* (2013.01); *H04R 1/04* (2013.01); *H04R 2420/07* (2013.01)

(58) Field of Classification Search

CPC ..... H01R 13/6272; H01R 13/6275; H01R 13/516; H01R 13/512; H01R 13/665; H01R 13/6691; H04R 1/04; H04R 2420/07

USPC ..... 439/352

See application file for complete search history.

(56) References Cited

U.S. PATENT DOCUMENTS

| | | | |
|---|---|---|---|
| 3,718,862 | A | 2/1973 | Norris |
| 4,910,795 | A | 3/1990 | McCowen et al. |
| 6,000,948 | A | 12/1999 | Peterson |

(Continued)

FOREIGN PATENT DOCUMENTS

| | | | |
|---|---|---|---|
| CN | 2679881 | Y | 2/2005 |
| CN | 200956601 | Y | 10/2007 |

(Continued)

OTHER PUBLICATIONS

Dec. 3, 2021—(CN) Office Action App No. 201980050691.7—Eng Trans.

(Continued)

*Primary Examiner* — Gary F Paumen

(74) *Attorney, Agent, or Firm* — Banner & Witcoff, Ltd.

(57) ABSTRACT

A connection assembly for connection to an audio device includes a connector module including a connector configured for electronic connection to a mating connector of the audio device and a releasable latch configured for retaining the connector module to the audio device, an actuator engageable with the connector module and being moveable to release the latch for removal of the connector module from the audio device, and locking structure configured to selectively resist movement of the actuator to release the latch.

24 Claims, 12 Drawing Sheets

(56) References Cited

U.S. PATENT DOCUMENTS

| | | | | |
|---|---|---|---|---|
| 6,722,902 | B2 | 4/2004 | Kedzierski | |
| 6,778,814 | B2 | 8/2004 | Koike | |
| 6,814,601 | B2 | 11/2004 | Lin | |
| 6,954,536 | B2 | 10/2005 | Tanaka | |
| 7,306,347 | B2 | 12/2007 | Selover | |
| 7,364,450 | B2 * | 4/2008 | Hafner | H01R 13/622 439/255 |
| 7,540,753 | B2 | 6/2009 | Dobler | |
| 7,857,643 | B2 | 12/2010 | Dobler | |
| 8,348,692 | B2 | 1/2013 | Montena | |
| 8,439,707 | B2 | 5/2013 | Montena | |
| 8,573,992 | B2 | 11/2013 | Roberts, Jr. et al. | |
| 8,911,254 | B2 | 12/2014 | Montena | |
| 8,965,026 | B2 | 2/2015 | Kamin-Lyndgaard | |
| 9,054,463 | B2 | 6/2015 | Kifedjian | |
| 9,992,566 | B2 | 6/2018 | Lai et al. | |
| 10,749,287 | B2 * | 8/2020 | Harwood | H01R 13/516 |
| 2006/0033218 | A1 | 2/2006 | Hafner et al. | |
| 2007/0237344 | A1 | 10/2007 | Oster et al. | |
| 2013/0089026 | A1 | 4/2013 | Piper et al. | |
| 2018/0159260 | A1 | 6/2018 | Powell | |
| 2018/0166836 | A1 | 6/2018 | Fritz et al. | |

FOREIGN PATENT DOCUMENTS

| | | | |
|---|---|---|---|
| CN | 202395189 | U | 8/2012 |
| CN | 203218520 | U | 9/2013 |
| CN | 104051875 | A | 9/2014 |
| CN | 106165208 | A | 11/2016 |
| CN | 107634386 | A | 1/2018 |
| DE | 202006002942 | U1 | 7/2007 |
| DE | 102006004488 | A1 | 8/2007 |
| DE | 102009014296 | A1 | 9/2010 |
| EP | 1744408 | A1 | 1/2007 |
| EP | 3399599 | A1 | 11/2018 |
| GB | 2488182 | A | 8/2012 |
| JP | 2010158007 | A | 7/2010 |
| TW | 346297 | U | 11/1998 |
| TW | 201328056 | A | 7/2013 |
| WO | 03055269 | A1 | 7/2003 |
| WO | 05048257 | A1 | 5/2005 |
| WO | 07008041 | A1 | 1/2007 |
| WO | 08098268 | A2 | 8/2008 |

OTHER PUBLICATIONS

Jan. 6, 2021—(TW) Search Report—App 108128242.

Nov. 5, 2019—(WO) International Search Report—App PCT/US2019/044163.

Sennheiser SKP 100 G3-B plug-on transmitter, product information, 5 pages, https://www.bax-shop.co.uk/snap-on-wireless-module/sennheiser-skp-100-g3-b-plug-on-transmitter, (dowloaded Jun. 14, 2018 2:54:53 PM].

Azden WX/T-PRO XLR Snap-on Mic/Transmitter Channel F2 (170.245) product information, 5 pages, https://3dhdgear.com/collections/wireless-audio-transmitter/products/azden-wx-t-pro-xlr-snap-on-mic-transmitter-channel-f2-170-245, (downloaded Jun. 14, 2018 2:57:08 PM).

Nov. 5, 2019—(WO) ISR & WO—App PCT/US2019/044163.

Feb. 15, 2022—(JP) Decision to Grant—App 2021-504751.

* cited by examiner

CONNECTION ASSEMBLY FOR AUDIO EQUIPMENT

CROSS-REFERENCE TO RELATED APPLICATION

This application is a continuation of, and claims priority to, U.S. patent application Ser. No. 16/058,444, filed Aug. 8, 2018, which is incorporated herein by reference in its entirety.

FIELD OF THE INVENTION

This disclosure relates to a connection assembly for audio equipment and an assembly including an audio device with such a connection assembly connected thereto, and more specifically to a connection assembly for connection to a microphone connector.

BACKGROUND

Audio devices, including input devices, output devices, processing devices, storage devices, etc., typically include physical connections for connection to each other. Such physical connections may be made using jacks, ports, plugs, and other connectors. However, such existing physical connections are generally not provided in a configuration that is both secure and easy to connect and disconnect. Additionally, some audio devices such as microphones are provided with a self-contained module that is connectable to the audio device via such a physical connection and provides functionality such as wireless transmission, processing of signals, or other operations. The need for a secure connection that can be quickly and easily connected and disconnected is particularly felt in connection with such self-contained modules.

The present disclosure is provided to address this need and other needs in existing connection assemblies for connection to microphones and other audio devices. A full discussion of the features and advantages of the present invention is deferred to the following detailed description, which proceeds with reference to the accompanying drawings.

BRIEF SUMMARY

Aspects of the disclosure relate to a connection assembly configured for connection to a microphone or other audio device, including a connector module including a connector configured for electronic connection to a mating connector of the audio device and a casing supporting the connector, a housing having a cavity with an opening, where the connector module extends into the opening and a first portion of the connector module is received in the cavity, and an actuator moveably received within the cavity of the housing. The connector module has a first locking structure and a latch supported by the casing, with the latch having a latching portion and an actuation surface. The latch is moveable between a latched position, where the latching portion is configured to engage the audio device to retain the connector module in connection with the audio device, and a release position, where the latching portion is not configured to retain the connector module in connection with the audio device. The actuator is axially moveable with respect to the connector module between a first position and a second position that is axially shifted from the first position, and the actuator has an engagement surface configured to engage the actuation surface of the latch to move the latch to the release position when the actuator is moved to the second position. The actuator further has a second locking structure, and the actuator is further moveable by rotation between a free position, where the second locking structure does not engage the first locking structure of the connector module and the actuator is moveable between the first and second positions, and a locked position, where the second locking structure engages the first locking structure of the connector module and resists axial movement of the actuator.

According to one aspect, the connector module further includes an electronic component in communication with the connector, and the casing supports the electronic component. The electronic component may include a computer device or any components of a computer device, such as a wireless transmitter.

According to another aspect, the first locking structure and the second locking structure have complementary inclined surfaces. For example, the first locking structure and the second locking structure may be in the form of complementary threading. The first locking structure may include a first threaded portion and the second locking structure may include a second threaded portion that is configured to engage the first threaded portion when the actuator is in the locked position. In one embodiment, the first locking structure further includes a third threaded portion opposite the first threaded portion, and the second locking structure further includes a fourth threaded portion opposite the second threaded portion, where the fourth threaded portion is configured to engage the third threaded portion when the actuator is in the locked position.

According to a further aspect, the connection assembly further includes a biasing member engaging the housing and the actuator to bias the actuator toward the first position.

According to yet another aspect, the latch is moveable by pivoting between the latched position and the release position.

According to a still further aspect, engagement between the first and second locking structures during movement of the actuator from the free position to the locked position is configured to move the actuator axially toward the connector of the connector module According to an additional aspect, the actuator is configured for rotation in a first rotational direction to move from the free position to the locked position and a second rotational direction opposite to the first rotational direction to move from the locked position to the free position, and the actuator has a wall extending from a bottom end. The connector module has a protrusion, and when the actuator is in the free position, the wall is configured to abut the protrusion to resist rotation of the actuator in the second rotational direction. In one embodiment, the wall includes a first wall portion and a second wall portion, the second wall portion having a greater axial length than the first wall portion, and when the actuator is in the free position, the second wall portion is configured to abut the protrusion to resist rotation of the actuator in the second rotational direction. In this embodiment, the wall may further have a slot defined between the first and second wall portions, where the protrusion and the slot are aligned when the actuator is in the free position, such that the protrusion is received in the slot when the actuator is moved to the second position. When the actuator is in the second position in this configuration, the second wall portion is configured to abut the protrusion to resist rotation of the actuator in the second rotational direction and the first wall portion is configured to abut the protrusion to resist rotation of the actuator in the first rotational direction.

According to a further aspect, the actuator includes a collar having a central passage defined by an inner surface, and the connector module extends through the central passage.

Additional aspects of the disclosure relate to a connection assembly configured for connection to a microphone, including a connector module having a connector configured for electronic connection to a microphone connector of the microphone, an electronic component in communication with the connector, and a casing supporting the connector and the electronic component, a housing, and a collar. The connector module has a first threaded portion on an outer periphery of the casing and a first pathway separate from the first threaded portion. The connector module further includes a latch having a latching portion and an actuation portion spaced from the latching portion and having an actuation surface. The latch is moveable by pivoting between a latched position, where the latching portion is configured to engage the microphone to retain the connector module in connection with the microphone, and a release position, where the latching portion is not configured to retain the connector module in connection with the microphone. The housing has a cavity with an opening, and the connector module extends into the opening such that a portion of the connector module is received in the cavity. The collar has a central passage defined by an inner surface, such that the connector module extends through the central passage. The collar is moveably received within the cavity of the housing and is axially moveable with respect to the connector module between a first position, where a top of the collar extends out of the opening of the housing, and a second position, where the collar is moved axially further into the housing relative to the first position. The collar has an engagement surface on the inner surface of the collar, and the engagement surface is configured to engage the actuation surface of the latch to move the latch to the release position when the collar is moved to the second position. The connection assembly further includes a biasing member engaging the housing and the collar to bias the collar toward the first position, where movement of the collar from the first position to the second position is configured to compress the biasing member. The collar further has a second threaded portion on the inner surface, and the collar is further moveable by rotation between a free position, where the second threaded portion is positioned within the first pathway of the connector module and the collar is moveable between the first and second positions such that the second threaded portion moves axially within the first pathway, and a locked position, where the second threaded portion engages the first threaded portion of the connector module and resists axial movement of the collar. Engagement between the first and second locking structures during movement of the collar from the free position to the locked position is also configured to move the collar axially toward the connector of the connector module.

According to one aspect, the electronic component includes at least one of a processor, a memory, and a wireless transmitter.

According to another aspect, the connector module further includes a third threaded portion on the outer periphery opposite the first threaded portion, and the collar further includes a fourth threaded portion on the inner surface opposite the second threaded portion, wherein the fourth threaded portion is configured to engage the third threaded portion when the collar is in the locked position.

According to a still further aspect, the biasing member is a coil spring positioned within the cavity of the housing and wrapped around the casing of the connector module.

According to an additional aspect, the engagement surface of the collar is defined by a necked portion at a top end of the collar, and the actuation surface of the latch is a ramped surface, and wherein the actuation surface and the engagement surface are both inclined relative to a center axis of the collar.

According to a further aspect, the connector module further includes a second biasing member configured to bias the latch toward the latched position.

Further aspects of the disclosure relate to a connection assembly configured for connection to a microphone, including a connector module including a first end having a connector configured for electronic connection to a microphone connector of the microphone and a second end opposite the first end, an electronic component in communication with the connector, and a casing supporting the connector and the electronic component, a housing, and a collar. The connector module has a first threaded portion extending across a portion of an outer periphery of the casing and a first sidewall portion that is recessed with respect to the first threaded portion and forms a first pathway located adjacent to the first threaded portion. The connector module further includes a latch having a latching portion and an actuation portion spaced from the latching portion and having an actuation surface. The latch is moveable by pivoting between a latched position, where the latching portion is configured to engage the microphone, and a release position, where the latching portion is not configured to retain the connector module in connection with the microphone. The housing has a cavity with an opening, where the connector module extends into the opening and the second end of the connector module is received in the cavity. The housing has an end cap opposite the opening and a rim extending inward around at least a portion of the opening. The collar has a central passage defined by an inner surface, where the connector module extends through the central passage, and a flange extending outward from an outer surface. The collar is moveably received within the cavity of the housing and is axially moveable with respect to the connector module between a first position, where a top of the collar extends out of the opening of the housing and the rim of the housing engages the flange to limit further movement of the collar outward through the opening, and a second position, where the collar is moved axially further into the housing relative to the first position. The collar has an engagement surface on the inner surface of the collar, and the engagement surface is configured to engage the actuation surface of the latch to move the latch to the release position when the collar is moved to the second position. The connection assembly further includes a biasing member engaging the end cap of the housing and the collar to bias the collar toward the first position, where movement of the collar from the first position to the second position is configured to compress the biasing member. The collar further has a second threaded portion on the inner surface, and the collar is further moveable by rotation between a free position, where the second threaded portion is positioned within the first pathway of the connector module and the collar is moveable between the first and second positions such that the second threaded portion is configured to move axially within the first pathway, and a locked position, where the second threaded portion engages the first threaded portion of the connector module and resists axial movement of the collar. Engagement between the first and second threaded portions during movement of the collar from the free position to the locked position is configured to move the collar axially toward the first end of the connector module. The connector may be an XLR connector in one embodiment.

According to one aspect, the electronic component may be a computer device comprising a memory and a processor and/or the electronic component may include a wireless transmitter.

According to another aspect, the rim extends inward around an entire inner periphery of the opening, and the flange extends outward around an entire periphery of the outer surface of the collar.

According to a further aspect, the connector module further has a third threaded portion extending across a second portion of the outer periphery of the casing and a second sidewall portion that is recessed with respect to the third threaded portion and forms a second pathway located adjacent to the third threaded portion, where the third threaded portion is located opposite the first threaded portion. The collar further has a fourth threaded portion on the inner surface opposite the second threaded portion. When the collar is in the free position, the fourth threaded portion is positioned within the second pathway of the connector module and is configured to move axially within the second pathway, and when the collar in in the locked position, the fourth threaded portion engages the third threaded portion of the connector module and resists axial movement of the collar.

According to yet another aspect, the biasing member is a coil spring positioned within the cavity of the housing and wrapped around the casing of the connector module.

According to a still further aspect, the engagement surface of the collar is defined by a necked portion at a top end of the collar, and the actuation surface of the latch is a ramped surface, and wherein the actuation surface and the engagement surface are both inclined relative to a center axis of the collar.

Other aspects of the disclosure relate to an assembly including an audio device with a connection assembly as described herein connected to a connector of the audio device. For example, in one embodiment, the assembly is a microphone assembly and includes a microphone having an audio receiver, a microphone body connected to the audio receiver, and a microphone connector connected to the microphone body and in communication with the audio receiver, with the microphone body having an engagement surface proximate to the microphone connector, and a connection assembly as described herein connected to the microphone. The latch of the connection assembly may engage the engagement surface of the microphone body when the microphone connector is connected to the connector of the connection assembly and the latch is in the latched position. The latch may include a latching portion that engages the engagement surface of the microphone to achieve this connection, and movement of the latch to the release position permits removal of the connection assembly from the microphone.

According to one aspect, the microphone body has a recess at an end of the microphone opposite the audio receiver, and the microphone connector is positioned in the recess, such that the connector of the connector module is configured to be received in the recess to connect to the microphone connector.

According to another aspect, the electronic component includes at least one of a processor, a memory, and a wireless transmitter.

According to a further aspect, the engagement surface of the collar is defined by a necked portion at a top end of the collar, and the actuation surface of the latch is a ramped surface, wherein the actuation surface and the engagement surface are both inclined relative to a center axis of the collar, and wherein the top end of the collar is configured to engage an end of the microphone proximate the microphone connector when the connector is connected to the microphone connector and the collar is in the locked position.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
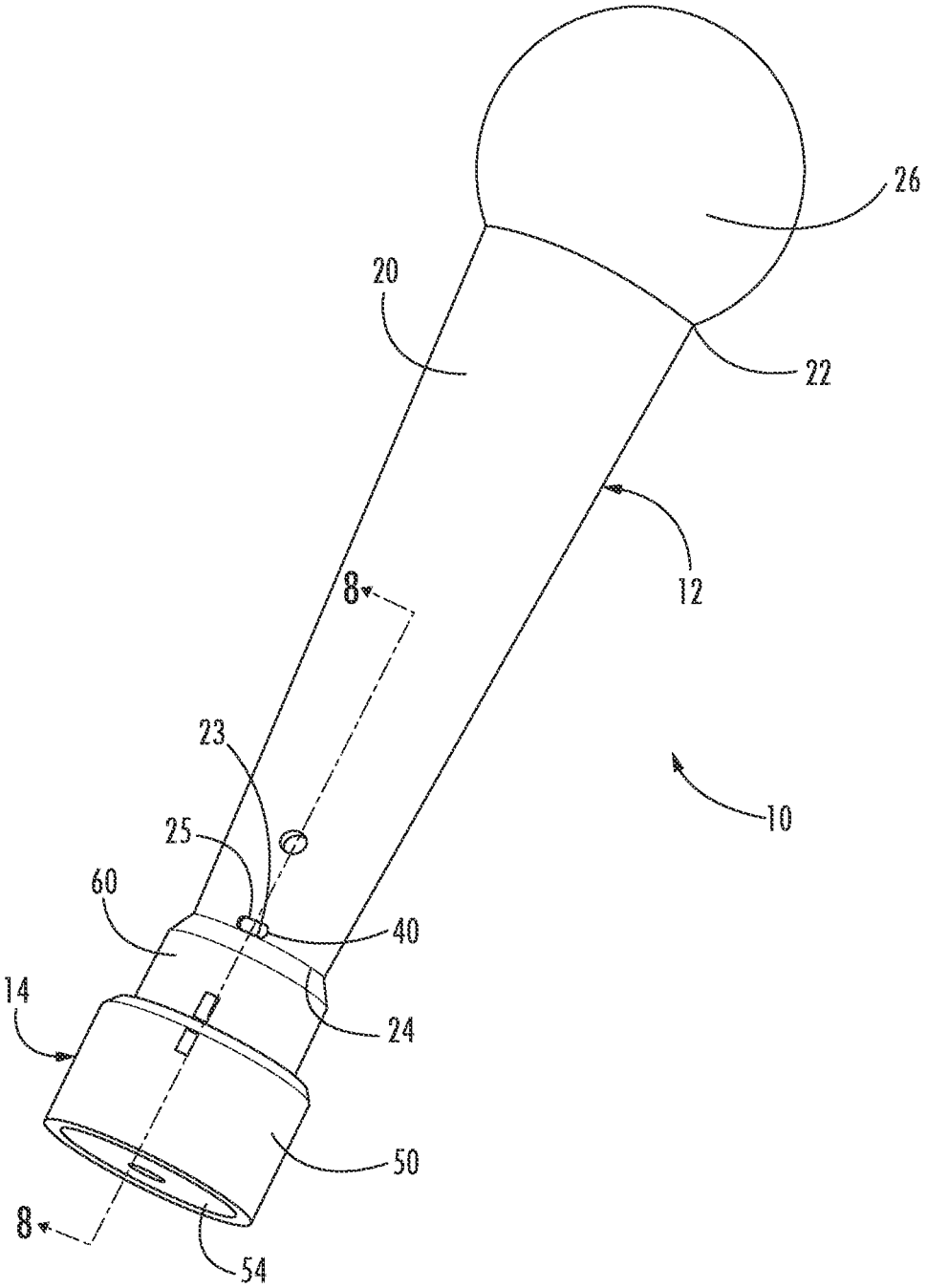
FIG. 1 is a perspective view of an assembly including an audio device in the form of a microphone with one embodiment of a connection assembly according to aspects of the disclosure connected to the microphone.
Figure 2:
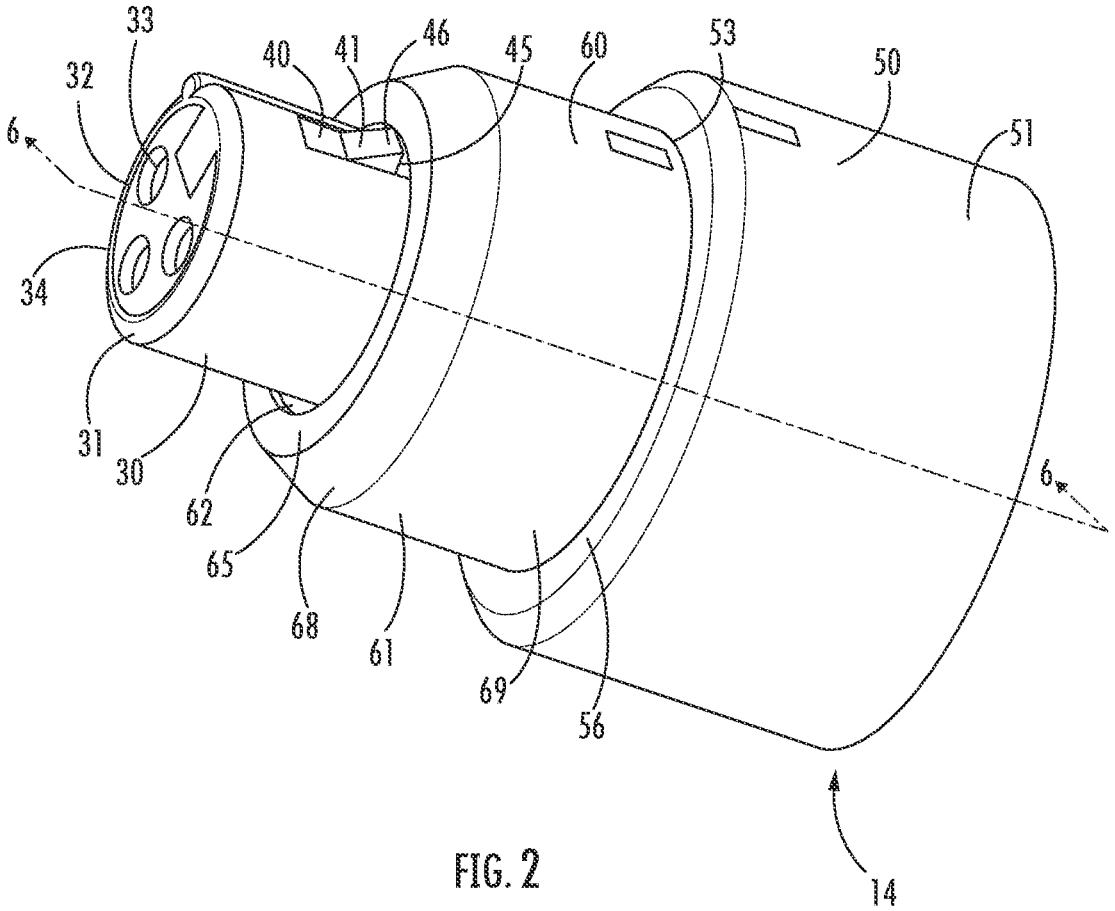
FIG. 2 is a perspective view of the connection assembly of FIG. 1.
Figure 3:
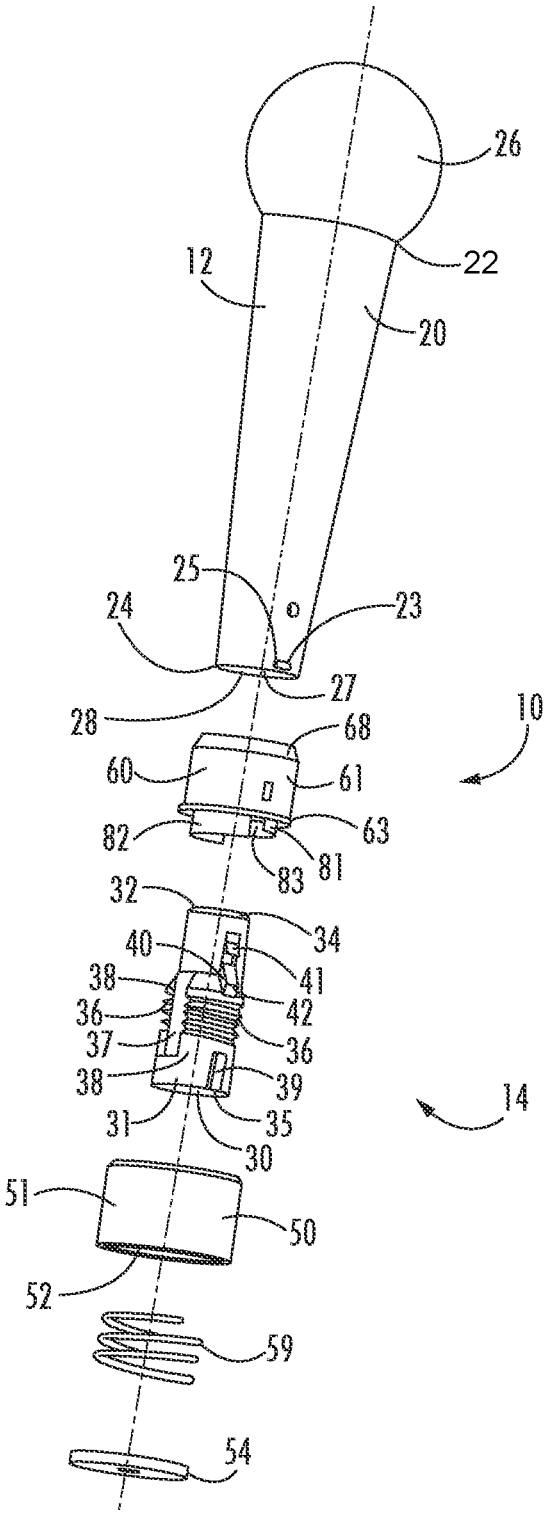
FIG. 3 is an exploded view of the assembly of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

General aspects of this disclosure relate to a connection assembly for connection to an electronic connector of an audio device, such as a connector for input and/or output of audio signals to/from the device. FIGS. 1-11 illustrate one embodiment of an assembly 10 that includes an audio device in the form of a microphone 12, with a connection assembly 14 connected to the microphone 12. While FIGS. 1-11 illustrate a microphone 12, in other embodiments, other audio devices may be used, including devices configured for audio input and/or output, such as speakers, headphones, media players, and others. The microphone 12 has a microphone body 20 with opposed first and second ends 22, 24, with an audio input or audio receiver 26 and a connector 28 located at opposite ends 22, 24. The connector 28 in this embodiment is a male connector in an XLR format, having three pins 29 positioned inside a recess 27 in the second end 24 of the microphone body 20. In other embodiments, other types of connectors 28 may be used, including male or female connectors in XLR formats or other types of electrical connectors. Such connectors may be in communication with audio components of the audio device, such as with the audio receiver 26 of the microphone 12, and/or other electrical components such as a processor, a memory, a transmitter/receiver (TX/RX), a power supply, etc., and may be configured to carry audio signals or other electrical signals and/or data, electrical power, etc. In the embodiment of FIGS. 1-11, the connector 28 (also referred to as the microphone connector 28) is configured to communicate audio signals (digital or analog) from the microphone, as well as optionally providing a power supply as well.

Figure 10:
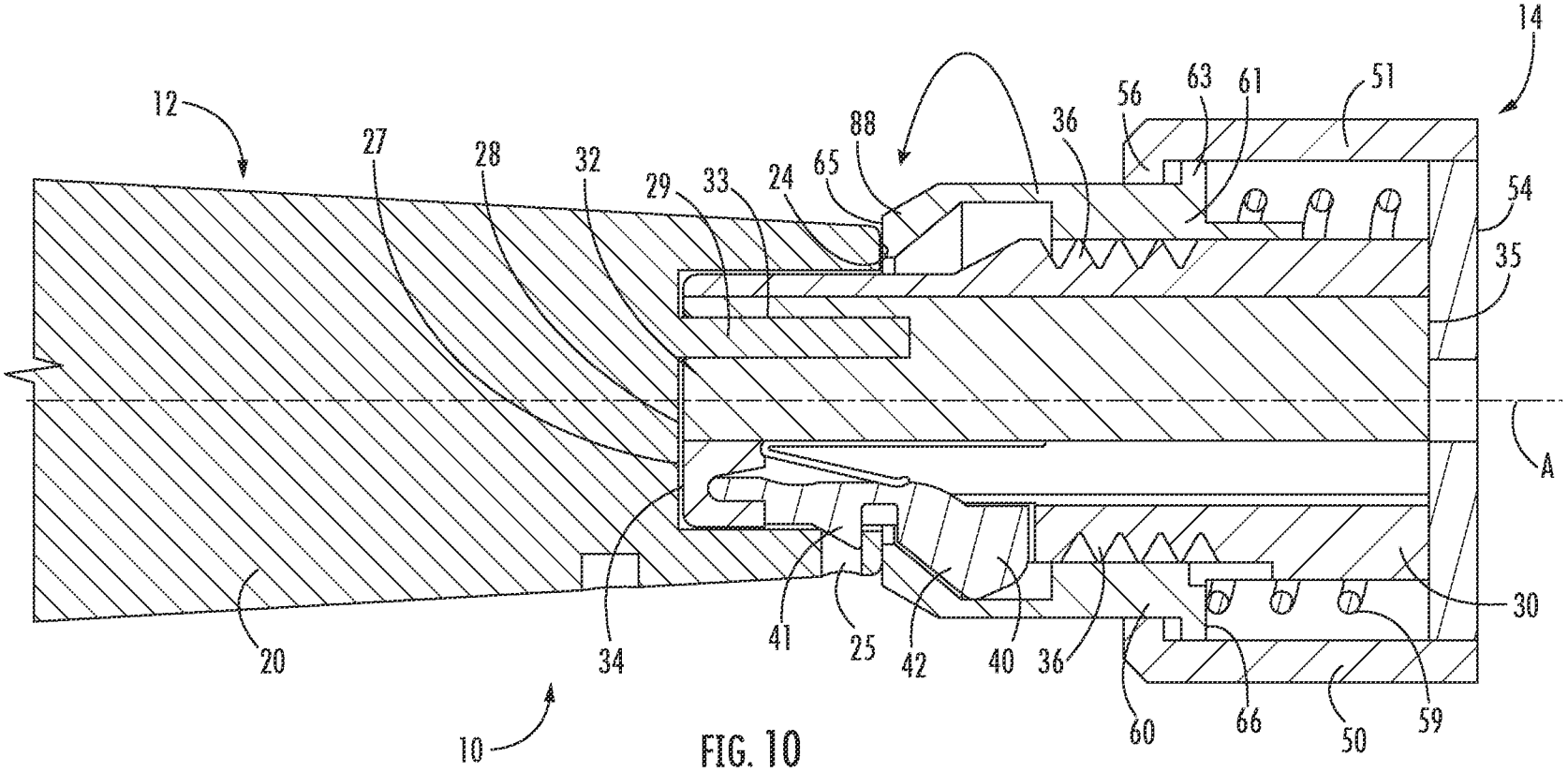
FIG. 10 is a cross-section view of the assembly of FIG. 8, showing the collar returned to the free position.
Figure 11:
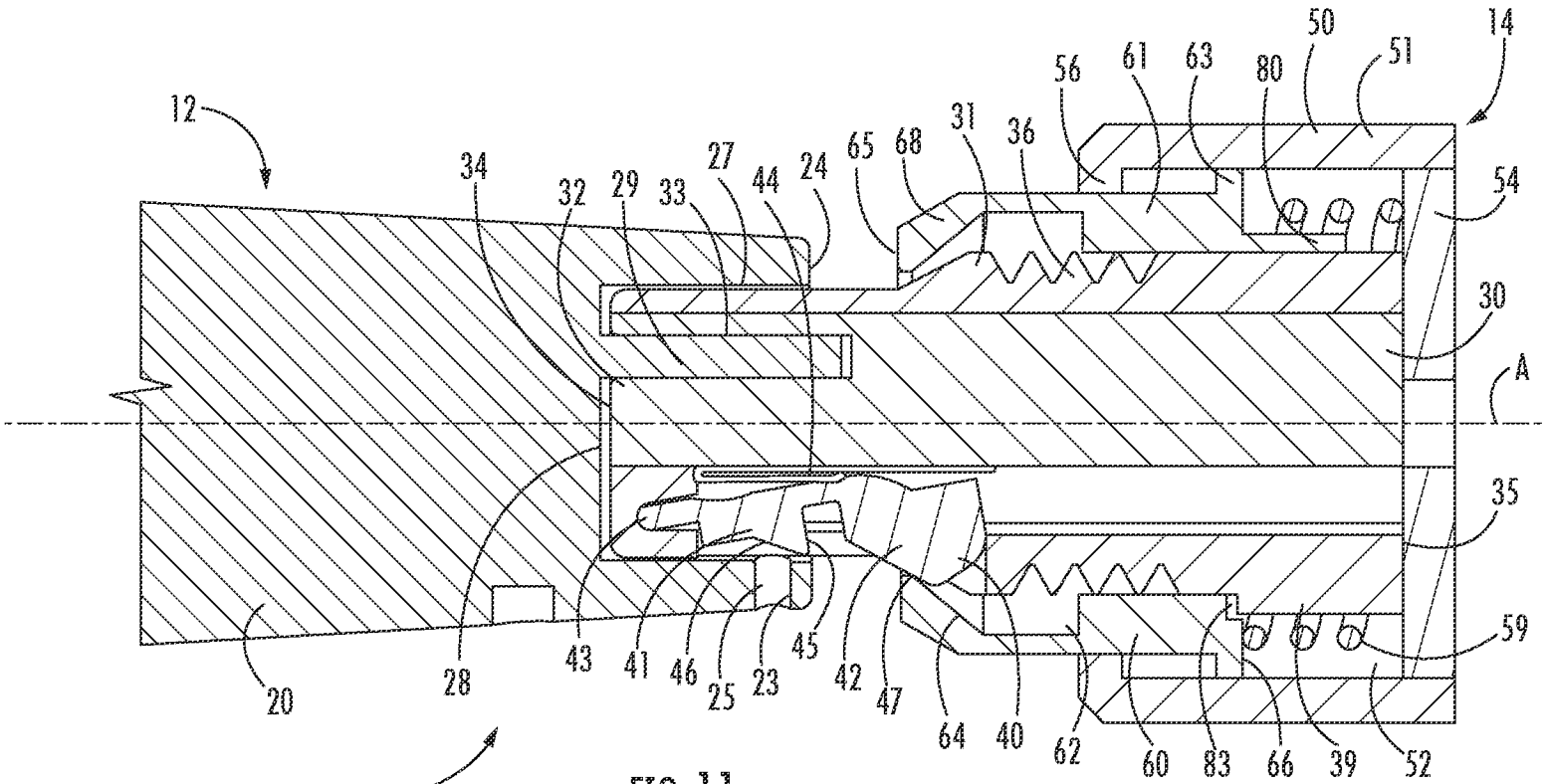
FIG. 11 is a cross-section view of the assembly of FIG. 10, showing the collar in a second position, actuating a latch of the connection assembly to a release position.
Figure 12:
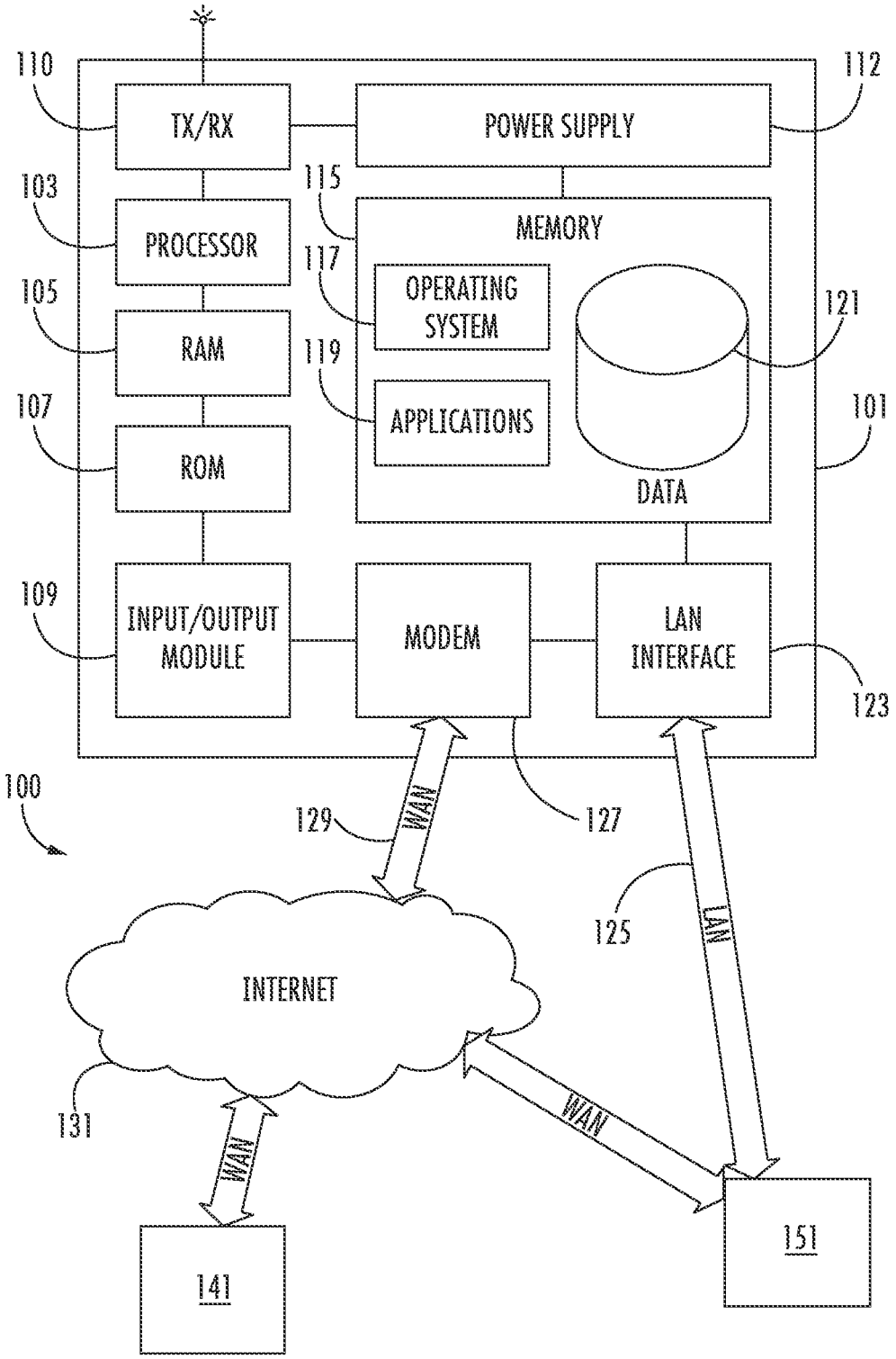
FIG. 12 schematically depicts one embodiment of a computer device capable of functioning as an electronic device according to aspects of the disclosure and a computing system including the computer device.

The embodiment of the connection assembly 14 in FIGS. 1-11 includes a connector module 30, a housing 50 receiving at least a portion of the connector module 30, and an actuator 60 extending at least partially around the connector module 30. The connection assembly 14 may further include one or more electronic devices 16 that are configured to be in communication with the microphone 12 or other audio device through connection with the connector 28. An electronic device 16 is illustrated schematically in FIG. 4, and in one embodiment, the electronic device 16 includes at least a wireless transmitter and/or receiver. In other embodiments, the electronic device 16 may additionally or alternately include a processor, a memory, and/or various other electronic components. One embodiment of an electronic device 16 in the form of a computer device is illustrated in FIG. 12 and described in greater detail herein, and it is understood that the electronic device 16 may include any or all of the components in FIG. 12, as well as additional components. The connection assembly 14 may include multiple electronic devices 16, or may not include an electronic device, in other embodiments. For example, the connection assembly 14 may be provided to connect a wire or cable to the audio device 12. The connection assembly 14 has one or more features for securing a connection between the connection assembly 14 and the audio device and/or releasing such a connection, as described herein.

The connector module 30 includes a casing 31 and various structures supported and/or enclosed by the casing 31, including a connector 32 configured for connection to the connector 28 of the audio device 12. The electronic device 16 may also be supported and/or enclosed by the casing 31 in one embodiment. While not illustrated in the drawings, the casing 31 may have one or more internal cavities to include components such as the electronic device 16, wiring and circuitry connecting the electronic device 16 to the connector 32, a power supply, and/or any other components contained in the casing 31. The connector 32 of the connector module 30 is generally configured to connect to the connector 28 of the audio device 12. For example, in the embodiment of FIGS. 1-11, the connector 32 is a female connector in a three-pin XLR format, having three holes 33 configured to receive the pins 29 of the microphone connector 28. The connector module 30 in FIGS. 1-11 has the connector 32 located at one end 34 (which may be called a connection end) and the casing 31 has a second end 35 (which may be called a distal end) opposite the connector 32. The casing 31 of the connector module 30 may be made from one piece or multiple pieces, and in one embodiment, the casing 31 is formed of a unitary structure that includes no moveable parts, whether the casing 31 is made of a single piece or multiple pieces.

The side walls of the casing 31 of the connector module 30 have at least one locking structure 36 configured for rotational locking with the actuator 60 as described elsewhere herein. In one embodiment, each locking structure 36 may include one or more ramped surfaces that are inclined with respect to the axis or axial direction A (see FIG. 6) of the connector module 30, such as a single ramped surface or a threaded portion extending around a portion of the outer periphery of the casing. Such an inclined locking structure can be engaged through rotational engagement and effects some axial advancement (i.e., along the axis A) during rotation. For example, in the embodiment of FIGS. 1-11, the connector module 30 has two locking structures 36 on opposite sides of the casing 31, each in the form of a threaded portion 36 extending around a portion of the outer periphery of the casing. In other embodiments, the connector module 30 may use one or more other types of locking structures 36, which may be configured for engagement by rotation or by other techniques. The connector module 30 may also include one or more pathways 37 that are separate from the locking structure(s) 36 and may be located adjacent to each locking structure 36. The pathways 37 may be structured such that any structures that can engage the locking structure(s) 36 (e.g., the locking structure XX of the actuator 60) do not engage the locking structure(s) 36 when positioned in the pathways 37. In the embodiment of FIGS. 1-11, each of the threaded portions 36 has a pathway 37 positioned adjacent the entrance of the threading, and the pathways 37 are defined by recessed and/or flattened portions of the side wall of the casing 31 (also referred to as sidewall portions) that are recessed relative to the adjacent threaded portion 36. The recessed sidewall portions defining the pathways 37 in FIGS. 1-11 extend substantially the entire distance between the threaded portions 36. The casing 31 in FIGS. 1-11 also includes sidewall portions 38 on opposite sides of the threaded portions 36, which have enlarged widths compared to the connector 32, and the pathways 37 are also recessed with respect to the sidewall portions 38 and extend at least partially through both sidewall portions 38. In one embodiment, the casing 31 may further include one or more protrusions 39 that are configured to engage the actuator 60 as described herein. The casing 31 of FIGS. 1-11 includes a single protrusion 39 proximate the second end 35.

The connector module 30 in one embodiment includes a latch 40 that is configured to lock the connector module 30 to the audio device 12, such as by engagement with an engagement surface 23 on the audio device 12. In the embodiment of FIGS. 1-11, the connector module 30 has a moveable latch 40, and the microphone 12 includes an engagement surface 23 within a slot 25 on the microphone body 20. The microphone 12 has the slot 25 in communication with at least the inner surface defining the recess 27, such that the engagement surface 23 can be accessed by the latch 40 from within the recess 27. In the embodiment of FIGS. 1-11, the slot 25 extends through the microphone body 20 to be exposed to the recess 27 and the exterior of the microphone 12. The latch 40 includes a latching portion 41 configured to engage the engagement surface 23 on the microphone 12 to retain the connector module 30 in connection with the microphone 12 and an actuation portion 42 configured to be engaged to disengage the latch 40 from the microphone 12. The latch 40 is moveable to engage and disengage the latching portion 41 with and from the microphone 12, such as being moveable between a latching position, where the latching portion 41 engages the engagement surface 23 on the microphone 12 to retain the connection assembly 14 in connection with the microphone 12, and a release position, where the latching portion 41 is disengaged from the engagement surface 23, permitting the connection assembly 14 to be removed from the microphone 12. The actuation portion 42 is configured to be engaged by the actuator 60 in the embodiment of FIGS. 1-11 as described herein, but may be differently engaged in another embodiment, such as by a user's finger or another structure of the connection assembly 14. As shown in FIGS. 10-11, the latch 40 is configured to move between the latching position (FIG. 10) and the release position (FIG. 11) by pivoting, and the latch 40 has a pivot arm 43 that forms a fulcrum for pivoting the entire latch 40. In other embodiments, the latch 40 may be moved in a different manner, including linear or curvilinear movement such as sliding, depressing, etc., or a combination of linear movement and pivoting/rotation about one or more axes. The connector module 30 in one embodiment may further include a latch biasing member 44 that biases the latch 40 toward the latching position. The connector module 30 in FIGS. 1-11 has a biasing member 44 in the form of a V-shaped spring that is compressed as the latch 40 is moved to the latching position, but other springs or other biasing mechanisms may be used in other embodiments.

The latching portion 41 in the embodiment of FIGS. 1-11 is in the form of a tab or similar structure having a latching surface 45 that engages the engagement surface 23 of the microphone and a ramped or inclined surface 46 adjacent the latching surface 45 that engages the periphery of the recess of the microphone 12 during insertion to pivot the latch 40 and permit insertion without direct manipulation of the latch 40. The actuation portion 42 is spaced and separate from the latching portion 41 in one embodiment, such as shown in FIGS. 1-11. In other words, the structure(s) of the actuation portion 42 that is/are engaged to move the latch between the latching position and the release position are different from the structures of the latching portion 41 that are engaged by the microphone to accomplish the latching function, even though the entire latch 40 may be a unitary or monolithic body. The actuation portion 42 in FIGS. 1-11 is in the form of an enlarged portion of the latch 40 with an actuation surface 47 that is ramped or inclined and configured to be engaged to actuate movement of the latch 40. The actuation portion 42 illustrated in FIGS. 1-11 is distal from the pivot arm 43 in order to require minimal force for actuation of the latch 40. Any or all components of the latch 40, including the latching portion 41 and the actuation portion 42, may be configured differently in other embodiments, and it is understood that the latching portion 41 may be configured to be matching or complementary with the structure of the audio device to which it latches.

The housing 50 has a housing body 51 that defines a cavity 52 that receives portions of the connector module 30 and/or the actuator 60. The housing body 51 in the embodiment of FIGS. 1-11 is generally cylindrical and has an opening 53 in communication with the cavity 52 at one end and an end cap 54 at the opposite end. The housing body 51 extends continuously around the cavity 52 in the embodiment of FIGS. 1-11 but may have gaps or spaces in the walls in other embodiments. The end cap 54 in the embodiment of FIGS. 1-11 completely closes the end of the cavity 52 and forms an abutment surface as discussed in greater detail herein. The end cap 54 may be a separate piece that is connected to the housing body 51 during assembly in one embodiment, using a permanent or releasable connection structure, in order to facilitate assembly, but may be integral with the end cap body 51 in other embodiments. The end cap 54 may leave one or more openings in the end of the cavity 52 or may be absent in other embodiments. For example, the end cap 54 may be configured to permit one or more wires or cables to extend through in one embodiment.

The housing 50 receives at least the second end 35 of the connector module 30 in the cavity 52 in one embodiment. The housing 50 in the embodiment of FIGS. 1-11 receives the second end 35 and a portion (about 50%) of the length of the casing 31 of the connector module 30, such that the second end 35 of the connector module abuts or is in close proximity to the end cap 54 in the normal resting position of the connection assembly 14. Additionally, the width of the housing 50 (i.e., the diameter in the embodiment of FIGS. 1-11) is sufficient to provide space 55 between the outer periphery of the casing 31 of the connector module 30 and the walls of the housing body 51. The housing 50 may also have a retaining structure for retaining a portion of the actuator 60 within the cavity 52 or otherwise in engagement with the housing 50 in one embodiment. In one embodiment, the housing 50 has a rim 56 extending inward around at least a portion of an interior of the housing 50, to retain a portion of the actuator 60 within the cavity 52. The housing 50 in the embodiment of FIGS. 1-11 has a rim 56 that extends inward around at least a portion of the periphery of the opening 53. The rim 56 in this embodiment extends around the entire periphery of the opening 53, and in other embodiments, the rim 56 may extend around only a portion of the periphery of the opening 53, such as a rim 56 formed by a number of inwardly-extending projections disposed intermittently around the opening 53. Different retaining structures for the housing 50 may be used in other embodiments, and it is understood that the actuator 60 may have a complementary structure for engagement by the retaining structure of the housing 50.

The actuator 60 in one embodiment is in the form of a collar having a collar body 61 defining a central passage 62 and is positioned so that the connector module 30 extends through the central passage 62. Additionally, the actuator 60 is positioned so that a portion of the actuator 60 (including at least a bottom 66 of the collar body 61 in one embodiment) is received within the housing 50, and the actuator 60 has a retaining structure to engage the retaining structure of the housing 50, retaining the portion of the actuator 60 within the housing 50. Additionally, a portion of the actuator 60 (including at least a top 65 of the collar body 61 in one embodiment) extends out of the opening 53 of the housing 50. In one embodiment, the actuator 60 has a flange 63 extending outward around at least a portion of the outer surface of the actuator 60, such as in the embodiment of FIG. 11, where the flange 63 extends around the entire periphery of the actuator 60 at the bottom 66 of the collar body 61. In other embodiments, the flange 63 may be positioned differently and/or may not extend around the entire periphery of the actuator 60, such as a flange 63 formed by a number of outwardly-extending projections disposed intermittently around the body 61. In other embodiments, the actuator 60 may not be configured as a collar with a collar body 61 that extends completely around the connector module 30, and other configurations that achieve the desired functionality may be used.

The actuator 60 in one embodiment is configured for movement to engage the actuating portion 42 of the latch 40 and is also configured for movement to lock the actuator 60 in place with respect to the connector module 30 and/or the housing 50. In the embodiment of FIGS. 1-11, the actuator 60 is moveable axially (in the axial direction A) in order to actuate the latch and is also moveable by rotation to engage the connector module 30 to lock the actuator 60 in position axially with respect to the connector module 30. The actuator 60, the connector module 30, and the housing 50 include structures to create this movement and functionality.

In one embodiment, the actuator 60 has an engagement surface 64 that is configured to engage the actuation portion 42 of the latch 40 to move the latch 40 from the latched position to the release position, and the actuator 60 is moveable between a first position and a second position to create this engagement. In this embodiment, the actuator 60 in the first position, shown in FIG. 10, does not actuate the latch 40, and the latch 40 is in the latched position. Additionally, in this embodiment, when the actuator 60 is moved to the second position, shown in FIG. 11, the engagement surface 64 of the actuator 60 engages the actuation surface 47 of the actuation portion 42 of the latch 40 to move the latch 40 to the release position. The movement of the actuator 60 between the first and second positions may be linear, and such movement may be axial, as in the embodiment of FIGS. 1-11. The actuator 60 in the embodiment of FIGS. 1-11 moves axially further into the housing 50 and away from the connector 32 and the connection end 34 of the connector module 30 when moving to the second position, as shown in FIG. 11. In this embodiment, at least the top 65 of the actuator 60 still extends out of the opening 53 of the housing 50 in the second position. The engagement surface 64 is positioned and configured to engage the actuation portion 42 of the latch 40 and may be defined on the inner surface 67 of the actuator 60, as in the embodiment of FIGS. 1-11. The actuator 60 in FIGS. 1-11 has an engagement surface 64 extending inwardly around the central passage 62 at the top 65 of the collar body 61 to create a necked portion 68 with a reduction in diameter of the central passage 62 in order to engage the actuation surface 47 of the latch 40 via axial movement. The engagement surface 64 in this embodiment is ramped or inclined inwardly and is also annular, creating a frusto-conical structure. The actuation surface 47 of the latch 40 is similarly ramped or inclined in order to create more gradual engagement. In the embodiment of FIGS. 1-11, the outer surface 69 of the collar body 61 is also inclined inwardly at the necked portion 68. In other embodiments, the engagement surface 64 and/or the necked portion 68 may have a different structure. For example, the engagement surface 64 in one embodiment may extend inwardly, while the outer surface 69 of the collar body 61 may remain cylindrical. As another example, the engagement surface 64 and the necked portion 68 in one embodiment may extend inward perpendicular to the axial direction A. As a further example, the engagement surface 64 may not be formed by a portion of the inner surface 67 of the collar body 61, and may instead be a separate structure such as a tab or protrusion, or may be located elsewhere on the actuator 60, in various embodiments.

The connection assembly 14 in the embodiment of FIGS. 1-11 further includes an actuator biasing member 59 that is configured to bias the actuator 60 toward the first position. The actuator biasing member 59 in this embodiment is a coil spring that is positioned in the cavity 52 of the housing 50 and wraps around a portion of the casing 31 of the connector module 30. The end cap 54 forms one abutment surface for the coil spring, and the underside of the flange 63 of the actuator 60 forms a second abutment surface. As shown in FIG. 11, movement of the actuator 60 to the second position compresses the biasing member 59, and the biasing member 59 expands during movement of the actuator 60 back to the first position. The engagement of the rim 56 of the housing 50 with the flange 63 of the actuator 60 limits further axial movement of the actuator 60 toward the connector 32 when the actuator 60 is in the first position. The actuation portion 42 of the latch 40 and the sidewall portions 38 are too large to fit through the necked portion of the actuator 60, even when the latch 40 is moved to the release position, so that the connector module 30 cannot move out of the actuator 60 and the housing 50.

In one embodiment, the actuator 60 and the connector module 30 have locking structures configured such that the locking structure 70 of the actuator 60 engages the locking structure 36 of the connector module 30 to resist movement of the actuator 60 to the second position and inadvertent release of the latch 40. In this embodiment, the actuator 60 may be positionable in a locked position, where the locking structures, 70, 36 of the actuator 60 and the connector module 30 engage each other to resist movement of the actuator 60 to the second position, and a free position, where the locking structures 70, 36 do not engage each other and the actuator 60 can move to the second position. The locking structures 70, 36 may be engaged using a different motion than the movement of the actuator 60 when moving to the second position to release the latch 40. For example, if the actuator 60 moves axially between the first and second positions, as in FIGS. 1-11, the locking structures 70, 36 may be configured to be actuated by relative rotational movement between the actuator 60 and the connector module 30. In one embodiment, these locking structures 70, 36 are in the form of one or more ramped surfaces on the actuator 60 and the connector module 30 that engage each other through rotation, such as a single ramped surface or a threaded portion. In one embodiment, the ramped surface(s) of the locking structures 70, 36 may be circumferential and inclined with respect to the axis or axial direction A of the connector module 30. In the embodiment, of FIGS. 1-11, the actuator 60 and the connector module 30 each have one or more threaded portions 70, 36 that engage each other. As seen in FIGS. 3-11, the actuator 60 has two threaded portions 70 positioned on the inner surface 67 of the collar body 61, with each threaded portion 70 extending around a portion of the inner surface 67 of the collar body 61 and around a portion of the periphery of the central passage 62. The threaded portions 70 of the actuator 60 are positioned on opposite sides of the collar body 61 and opposite sides of the passage 62 in one configuration. As described herein, the connector module 30 in the embodiment of FIGS. 1-11 has locking structures in the form of two threaded portions 36 each extending around a portion of the outer periphery of the casing 31.

Figure 4:
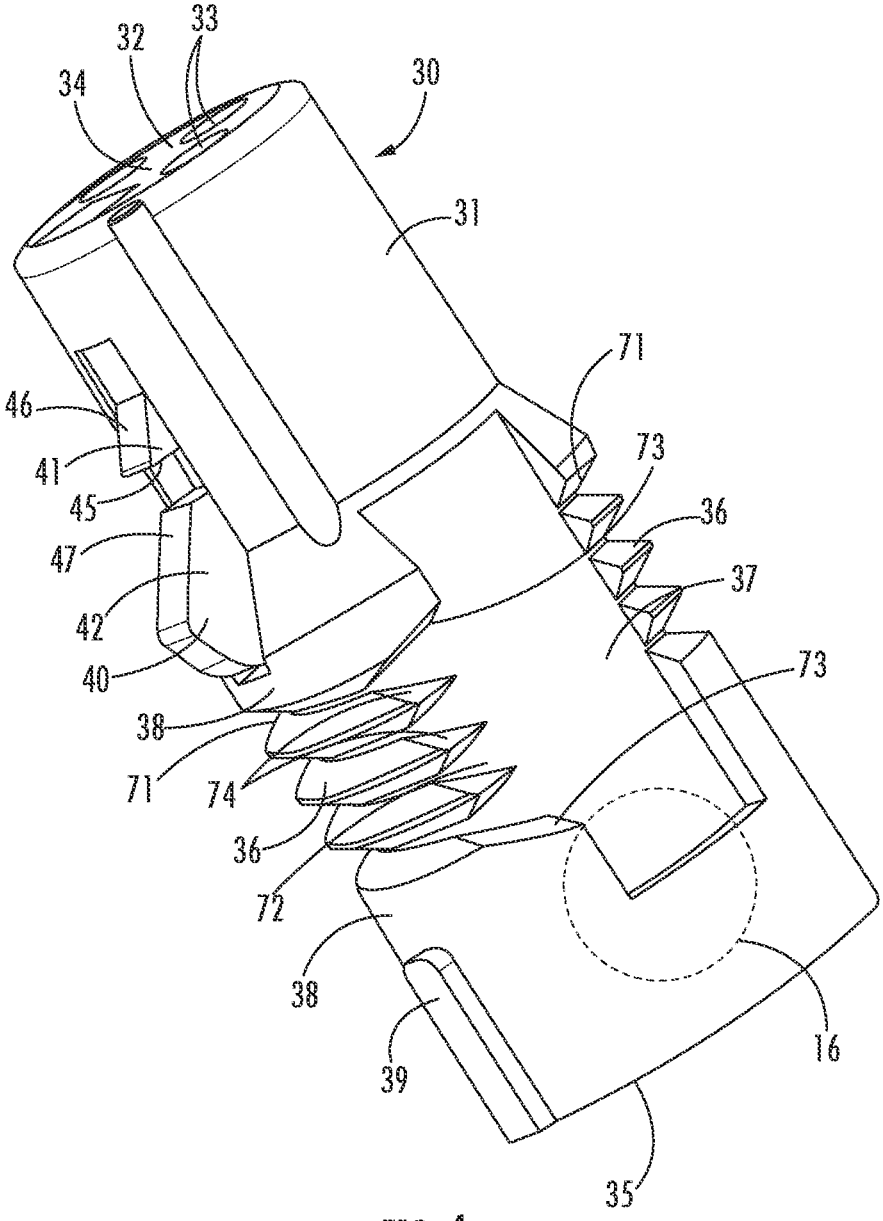
FIG. 4 is a perspective view of a connector module of the connection assembly of FIG. 1.
Figure 5:
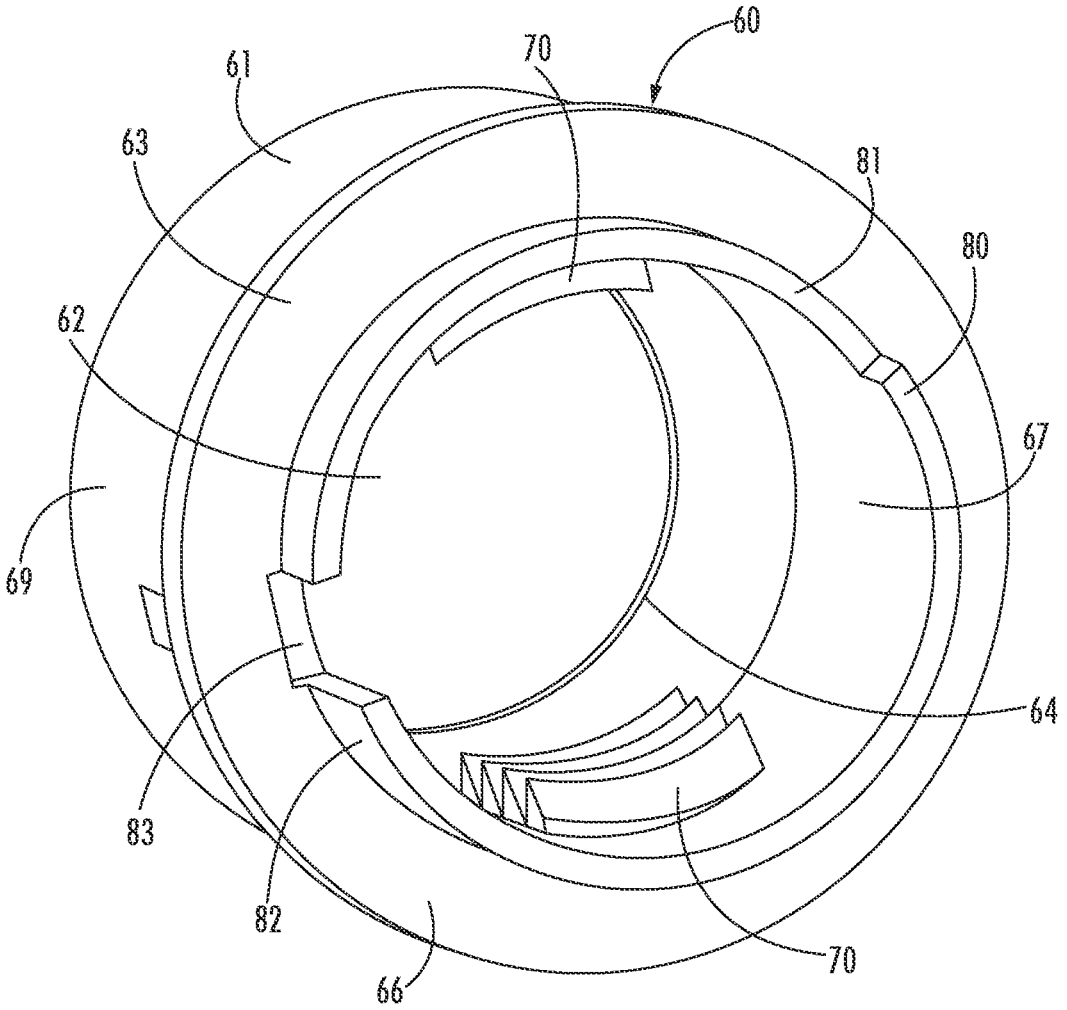
FIG. 5 is a perspective view of an actuator of the connection assembly of FIG. 1 in the form of a collar.
Figure 6:
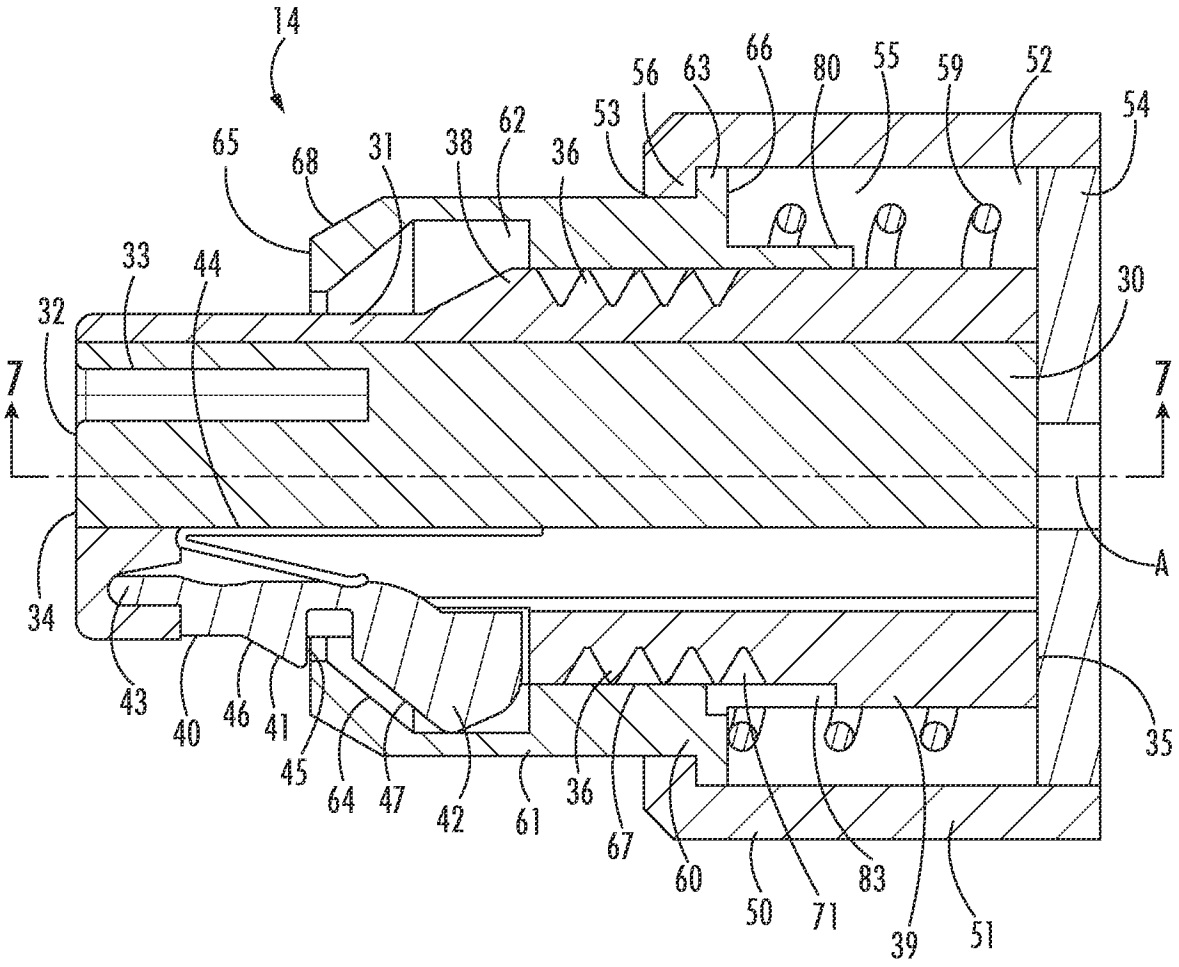
FIG. 6 is a cross-section view taken along lines 6-6 of FIG. 2.

The casing 31 of the connector module 30 has guide features to guide and facilitate mating of the threaded portions 36 with the threaded portions 70 of the actuator 60 without perfect alignment between the components. For example, the threaded portions 36 are positioned in channels 71 between the two sidewall portions 38, and each channel 71 has a flared entrance 72 formed by beveled portions 73 of the sidewall portions 38, as shown in FIG. 4. As another example, the entrance ends of the threaded portions 36 (where engagement with the threaded portions 70 begins by relative rotation of the actuator 60) are tapered to a narrowed or pointed end 74. When the beveled portions 73 and the pointed ends 74 are engaged by the threaded portions 70 due to slight misalignment, the oblique angles of these surfaces gradually guide proper engagement and alignment between the threaded portions 70, 36. The threaded portions 70 of the actuator 60 may also be provided with tapered ends 74 or other guiding features. In the embodiment of FIGS. 1-11, the threaded portions 70, 36 are configured for engagement by rotating in a single direction, and in such an embodiment, only a single end of each threaded portion 36 may have these guide features. In another embodiment, both ends of each threaded portion 36 may have these guide features, particularly if the threaded portions 70, 36 can be engaged by rotation in either direction.

The free position of the actuator 60 is illustrated in FIGS. 6-8 and 10-11, in which the threaded portions 70 of the actuator 60 do not engage the threaded portions 36 of the connector module 30. In this configuration, the actuator 60 can move axially to the second position, as shown in FIG. 11. Additionally, in this configuration, the threaded portions 70 of the actuator 60 are positioned in the pathways 37 of the connector module 30 (see FIG. 7) and move axially within the pathways 37 as the actuator 60 moves between the first and second positions. It is understood that the pathways 37 in this embodiment are positioned along the direction of movement of the actuator 60 between the first and second positions, and if the actuator 60 is configured to move differently between the first and second positions in another embodiment, the pathways 37 may be configured along the direction of such movement. In other embodiments that utilize different locking structures, the pathways 37 and the locking structure 70 of the actuator 60 may be configured to permit passage of the locking structure 70 during this movement of the actuator 60.

Figure 7:
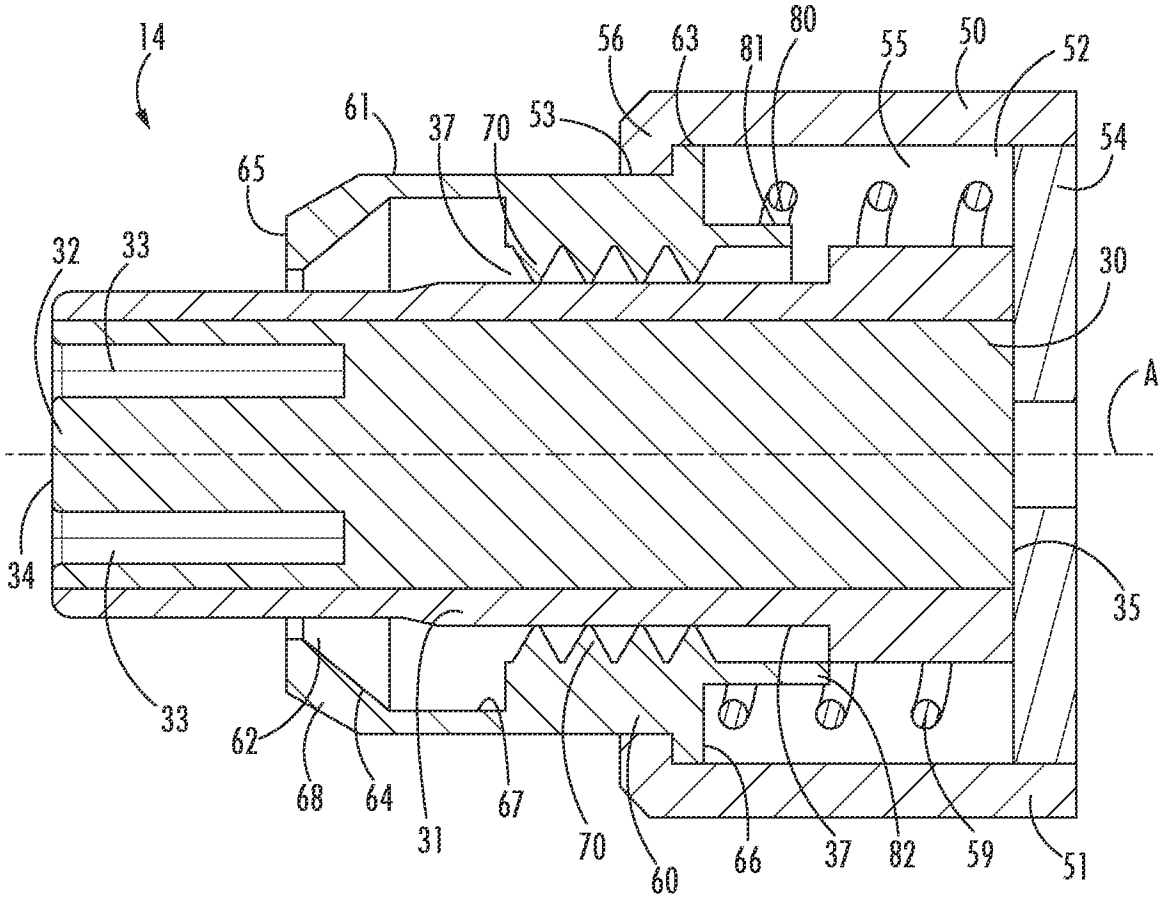
FIG. 7 is a cross-section view taken along lines 7-7 of FIG. 6.
Figure 8:
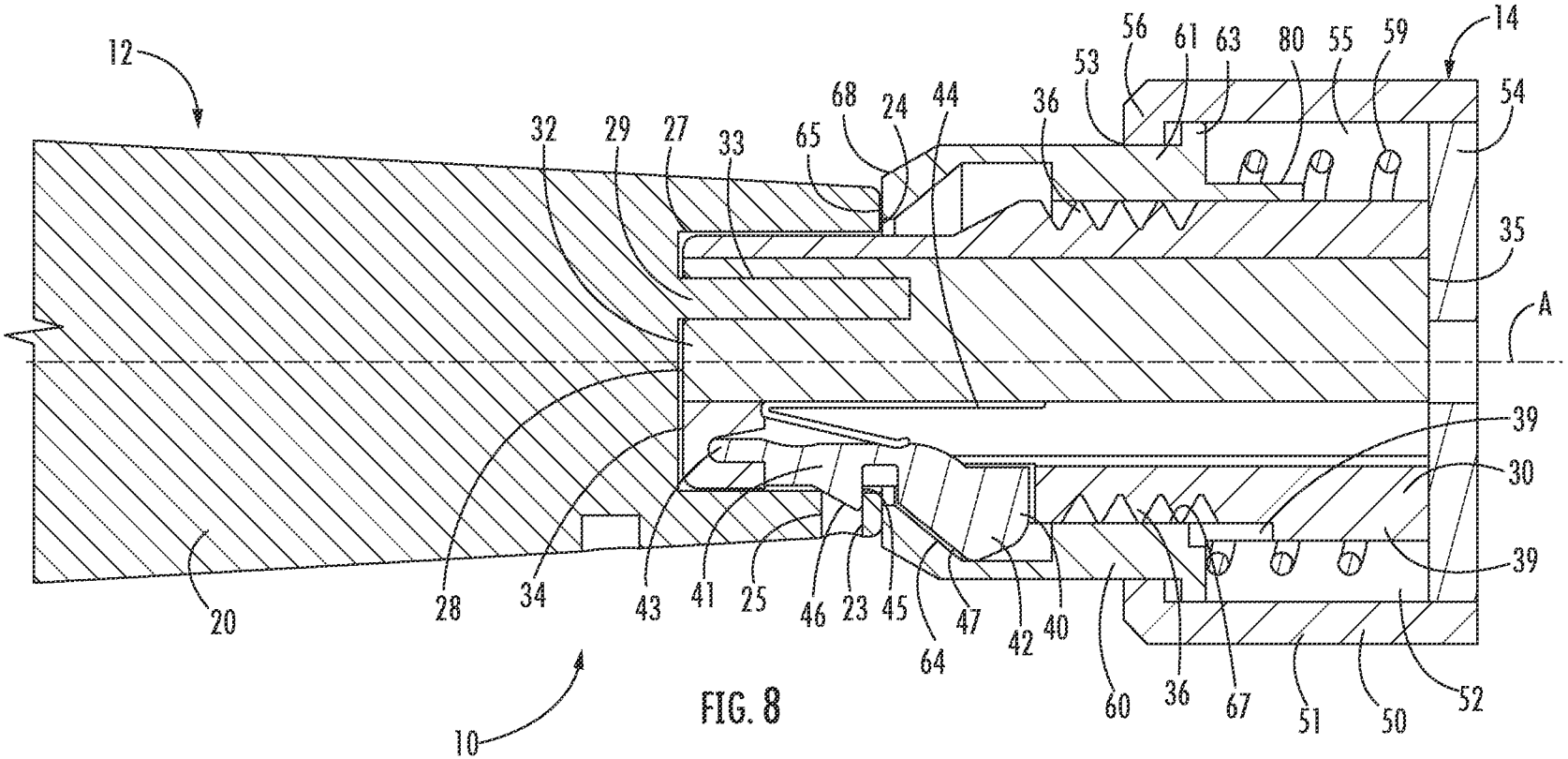
FIG. 8 is a cross-section view taken along lines 8-8 of FIG. 1, with the collar in a free position.
Figure 9:
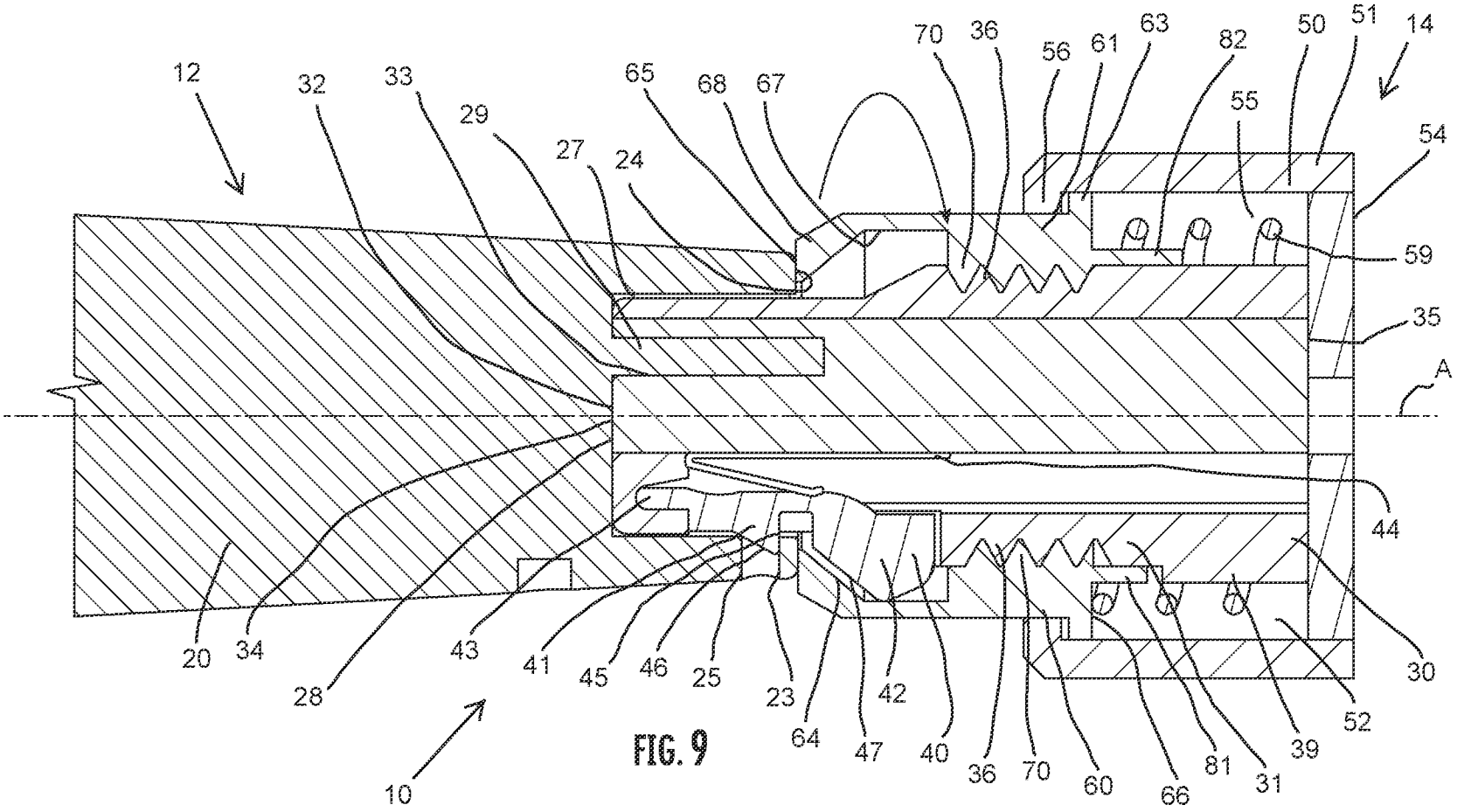
FIG. 9 is a cross-section view of the assembly of FIG. 8, with the collar in a locked position.

The locked position of the actuator 60 is illustrated in FIG. 9, and the actuator 60 is moved from the free position to the locked position by rotation of the actuator 60 in the clockwise direction when viewed axially from the connector 32. In the locked position, the threaded portions 70, 36 of the actuator 60 and the connector module 30 are threadably engaged, as shown in FIG. 9. This engagement resists axial movement of the actuator 60. The actuator 60 can be returned to the free position by counterclockwise rotation of the actuator 60, as shown in FIG. 10. This rotation back to the free position returns the threaded portions 70 into position within the pathways 37 as shown in FIG. 7. Additionally, in the embodiment of FIGS. 1-11, the incline of the threaded portions 70, 36 creates axial advancement of the actuator 60 when the actuator 60 is moved to the locked position, i.e., movement of the actuator 60 along the axial direction A toward the connector 32 and/or the audio device 12. This axial movement presses the actuator 60 (e.g., the top 65 of the collar body 61) into closer engagement with the end 24 of the audio device 12, further securing and stabilizing the connection between the connection assembly 14 and the audio device 12. This axial advancement can also compensate for manufacturing tolerances that may otherwise result in a loose connection. For example, there can be significant variance in the position of the slot 25 relative to the second end 24 of the microphone body 20, and this axial advancement allows compensation for this variance. Because of this variance, the exact rotational position of the actuator 60 relative to the connector module 30 in the locked position may vary depending on the degree of axial advancement permitted by the specific audio device 12 to which the connection assembly 14 is connected. Thus, it is understood that the actuator 60 may have many rotational positions that are each considered to be a "locked position," and the locked position(s) is/are defined by engagement between the locking structures 70, 36 to resist axial movement of the actuator 60, rather than a specific rotational position of the actuator 60. Rotation of the actuator 60 from the locked position to the free position similarly results in axial retreat of the actuator, i.e., movement of the actuator 60 along the axial direction A away from the connector 32 and/or the audio device 12. This axial movement can be accomplished by other embodiments using locking structures 70, 36 with inclined surfaces. In another embodiment, the threaded portions 70 may be configured to permit locking by rotation in either direction, such that each threaded portion 70 may be engaged with either of the threaded portions 36 of the connector module 30. It is noted that "rotation" of the actuator 60 as described herein refers to rotation of the actuator 60 relative to the connector module 30, and that such relative rotation can be accomplished by rotation of the actuator 60 or the connector module 30 alone, or simultaneous rotation of both components.

The actuator 60 in FIGS. 1-11 further includes a wall 80 that extends axially from the bottom 66 of the collar body 61 with a cylindrical shape, which forms a stop to limit retraction of the actuator 60 within the housing 50 and/or to limit rotation of the actuator 60. The wall 80 includes a first wall portion 81 and a second wall portion 82 that are each semi-cylindrical in shape, continuous with each other, and have different axial lengths, such that the second wall portion 82 is longer than the first wall portion 81. The wall 80 may also have one or more slots 83 defined therein and configured to receive the one or more protrusions 39 of the connector module 30. The wall 80 in FIGS. 1-11 includes a single slot 83 located between the wall portions 81, 82, and the slot 83 and the protrusion 39 are positioned to be aligned when the actuator 60 is in the free position. In this configuration, movement of the actuator 60 to the second position causes the protrusion 39 to be received in the slot 83, and if this alignment is not present, the wall 80 (e.g., the first wall portion 81) will abut the top end of the protrusion 39 to resist axial movement of the actuator 60. When the protrusion 39 is received in the slot 83, rotation of the actuator 60 in either direction is resisted by the edges of the slot 83. In the embodiment of FIGS. 1-11, the first wall portion 81 will abut the protrusion 39 if the actuator 60 is rotated in a first rotational direction (from the free position toward the locked position), and the second wall portion 82 will abut the protrusion 39 if the actuator 60 is rotated in a second rotational direction opposite to the first rotational direction. Additionally, the wall 80 may limit retraction of the actuator 60 into the housing 50, by the second sleeve portion 82 abutting the end cap 54 of the housing 50 and/or the end of the protrusion 39 abutting the top end of the slot 39. Further, the length of the second sleeve portion 82 is sufficient to extend below the top of the protrusion 39, while the first sleeve portion 81 does not extend below the top of the protrusion 39. In this configuration, the protrusion 39 also forms a rotation stop, such that the first sleeve portion 81 passes over the top of the protrusion during rotation of the actuator 60 to move the actuator 60 in the first rotational direction from the free position to the locked position (e.g., in the clockwise direction), while the second sleeve portion 82 abuts the side of the protrusion 39 to resist rotation in the second rotational direction (e.g., the counterclockwise direction) from the free position. The end of the second sleeve portion 82 opposite the slot 83 also forms a rotation stop by abutting the side of the protrusion 39 to resist over-rotation of the actuator 60 in the first rotational direction after the actuator 60 has reached the locked position, in case engagement with the audio device 12 due to axial advancement of the actuator 60 does not sufficiently resist over-rotation past the locked position.

Connection of the audio device 12 to the connection assembly 14 is illustrated with respect to the microphone 12 of the embodiment of FIGS. 1-11, with the understanding that the connection assembly 14 may be connected to other audio devices in the same or a similar manner. As shown in FIG. 8, when the connection assembly 14 is connected to the microphone 12, the connectors 28, 32 of the microphone 12 and the connector module 30 are connected in a manner to permit electronic transmissions (e.g., signals, power supply, etc.) through the connectors 28, 32, which may include mating of components such as the pins 29 of the microphone connector 28 being received in the holes 33 of the connector module 30 and the connection end 34 of the connector module 30 being received in the recess 27 of the microphone 12. In the embodiment of FIGS. 1-11, the latch 40 engages the microphone 12 as the connectors 28, 32 are pushed into connection with each other. FIG. 8 illustrates the latching surface 45 of the latching portion 41 engaging the engagement surface 23 of the microphone 12, such that the latching portion 41 is at least partially received in the slot 25 on the microphone body 20. The end 24 of the microphone body 20 in this embodiment engages the ramped surface 46 of the latching portion 41 to push the latch 40 toward the release position, and the latch 40 returns to the latched position (e.g., via force exerted by the biasing member 44) to insert the latching portion 41 into the slot 25. Additionally, in the embodiment of FIGS. 1-11, the end 24 of the microphone 12 engages the top 65 of the collar body 61 and pushes the actuator 60 slightly away from the connector 32 (i.e., into the housing 50) in the axial direction A. This can be seen by comparison of FIG. 6, where the flange 63 of the actuator 60 engages the rim 56 of the housing 50, with FIG. 8, where the engagement with the microphone 12 has pushed the flange 63 slightly away from the rim 56. It is understood that, functionally speaking, both positions of the actuator 60 in FIGS. 6 and 8 may be considered to be the "first position" as described herein. If distinction is needed between these positions, they will be referred to as the advanced first position (FIG. 6) and the retracted first position (FIG. 8). Once the microphone 12 is connected to the connection assembly 14 in this manner, the actuator 60 can be rotated to the locked position, as shown in FIG. 9 and described herein, which may also create axial advancement of the actuator 60 as also described herein. When the actuator 60 is returned to the free position (FIG. 10) and then moved to the second position (FIG. 11), the microphone 12 can be pulled away from the connection assembly 14.

In the context of this disclosure, the electronic device 16 may be embodied as a computing system 100 or a computing device 101 within such a system 100, as shown in FIG. 12, either as a general computing system or device, or as a specialized computing system or device for a specific purpose. Accordingly, the electronic device 16 may include hardware, firmware and software utilized to process, modify, transmit, store, convert, or otherwise take actions with respect to audio signals received from the audio device 12, as well as performing other functions. Furthermore, those of ordinary skill in the art will appreciate that the computing system 100 and the computing device 101 may comprise processing hardware configured for intensive and/or high volume calculations in order to address complex interactions between multiple devices and systems utilized to transmit, receive, and take actions with respect to audio signals, such as audio input devices, audio output devices, audio processing devices, etc. As such, computing system 100 may include one or more connected computer devices, such as devices 101, 141, and/or 151. Further, in one example, computing system 100 may include one or more subsystems that may be implemented as one or more computer devices, such as device 101, 141, and/or 151.

In one example implementation, computing device 101 may have a processor 103 for controlling the overall operation of the device 101 and its associated components, including RAM 105, ROM 107, an input/output (I/O) module 109, and memory 115. In one example, as will be apparent to those of ordinary skill in the art, memory 115 may comprise any known form of persistent and/or volatile memory, such as, among others, a hard disk drive, a solid state disk, optical disk technologies (CD-ROM, DVD, Blu-ray, and the like), tape-based stored devices, ROM, and RAM, or combinations thereof. In this way, memory 115 may comprise a non-transitory computer-readable medium that may communicate instructions to processor 103 to be executed.

I/O module 109 may include a microphone or other audio input device, keypad, touch screen, button, and/or stylus through which a user of the computing device 101 may provide input, and may also include one or more of a speaker for providing audio output and/or a video display device for providing textual, audiovisual and/or graphical output. Software may be stored within memory 115 and/or storage to provide instructions to the processor 103 for allowing the computing device 101 to perform various functions. For example, memory 115 may store software used by the computing device 101, such as an operating system 117, application programs 119, and an associated database 121. The processor 103, and its associated components, may allow the computing device 101 to run a series of computer-readable instructions to process and format data.

The computing device 101 may further include a transmitter and/or receiver (TX/RX) 110 and a power supply 112, as illustrated in FIG. 12. The TX/RX 110 may be configured for wireless transmission and/or reception through one or more wireless communication channels (including but not limited to: WiFi®, Bluetooth®, Near-Field Communication (NFC), ANT technologies and/or other wireless communication techniques). In one embodiment, all communications with external devices may be done through the TX/RX 110. The TX/RX 110 may further include an antenna as shown in FIG. 12. The power supply 112 may be connected to power any or all other components of the computing device 101 and may be rechargeable or removeable/replaceable in one embodiment.

The computing device 101 may operate in a networked environment supporting connections to one or more remote computers, such as computing devices 141 and 151. In one example, the computing devices 141 and 151 may be personal computers or servers that include many, or all, of the elements described above relative to the computing device 101. Alternatively, computing device 141 and/or 151 may be a data store that is affected by the operation of the computing device 101. The network connections depicted in FIG. 12 include a local area network (LAN) 125 and a wide area network (WAN) 129, but may also include other networks. When used in a LAN networking environment, the computing device 101 is connected to the LAN 125 through a network interface or adapter 123. When used in a WAN networking environment, the computing device 101 may include a modem 127 or other means for establishing communications over the WAN 129, such as the Internet 131. It will be appreciated that the network connections shown are illustrative and other means of establishing a communications link between the computers may be used. The existence of any of various well-known protocols such as TCP/IP, Ethernet, FTP, HTTP and the like is presumed. Accordingly, communication between one or more of computing devices 101, 141, and/or 151 may be wired or wireless, and may utilize Wi-Fi, a cellular network, Bluetooth, infrared communication, or an Ethernet cable, among many others.

Additionally, an application program 119 used by the computing device 101 according to an illustrative embodiment of the disclosure, may include computer-executable instructions for invoking functionality related to management of design, manufacture, and service processes associated with an engineering product, and specifically, for communication of one or more rules associated with the design and/or manufacture of a sub-component of the engineered product between one or more sub-systems of a change management system.

The computing device 101 and/or the other devices 141 or 151 may also be mobile devices, such as smart phones, personal digital assistants (PDAs), smart watches, and the like, which may include various other components, such as a battery, speaker, and antennas (not shown).

The disclosure is operational with numerous other general purpose or special purpose computing system environments or configurations. Examples of well-known computing systems, environments, and/or configurations that may be suitable for use with the disclosure include, but are not limited to, personal computers, server computers, hand-held or laptop devices, multiprocessor systems, microprocessor-based systems, set top boxes, programmable consumer electronics, network PCs, minicomputers, mainframe computers, and distributed computing environments that include any of the above systems or devices, and the like.

The disclosure may be described in the general context of computer-executable instructions, such as program modules, being executed by a computer. Generally, program modules include routines, programs, objects, components, data structures, and the like that perform particular tasks or implement particular abstract data types. The disclosure may also be practiced in distributed computing environments where tasks are performed by remote processing devices that are linked, for example, through a communications network. In a distributed computing environment, program modules may be located in both local and remote computer storage media including memory storage devices. In one embodiment, the computer device 101 may include computer-executable instructions for transmitting, receiving, processing, modifying, storing, converting, or otherwise taking action with respect to audio signals.

In one embodiment, the electronic device 16 is a wireless transmission module that is configured for wireless transmission of audio signals from the audio device 12. In this embodiment, the electronic device 16 includes at least a wireless transmitter 110 with an antenna and a power supply 112, and additional components described herein may be included. In an embodiment where the electronic device 16 is configured for wireless transmission and/or reception, the connection assembly 14 may include at least some components formed of plastic or other material that does not interfere with wireless signals, to ensure that the antenna is not entirely shielded. For example, in one embodiment, the casing 31 of the connector module 30 and the housing 50 may be at least partially made from plastic, and each of these components may be made entirely of molded plastic in another embodiment. The actuator 60 may likewise be made at least partially from plastic, or entirely of molded plastic, in one embodiment.

A connection assembly 14, as well as an assembly 10 including the connection assembly 14 and an audio device 12, provide benefits and advantages relative to existing assemblies. For example, the connection assembly 14 enables quick and easy connection to the audio device 12, as well as quick and easy disconnection from the audio device 12. As another example, the connection assembly 14 provides the advantage of quick and easy disconnection with minimal risk of inadvertent disconnection. As a further example, the connection assembly 14 provides the ability to secure and stabilize the connection between the connection assembly 14 and the audio device 12. As yet another example, the structures of the connection assembly 14 enable consistent and reliable operation. In one embodiment, the connection assembly 14 may be provided as a wireless transmission module that can be connected to a microphone 12 that is configured for a wired connection, to create a reliable and convenient wireless microphone assembly 10.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. The term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A connection assembly configured for connection to an audio device, comprising:

a connector module including a connector configured for electronic connection to a mating connector of the audio device and a casing supporting the connector, the connector module having a first locking structure;

a latch moveable between a latched position, where the latch is configured to engage the audio device and the connector module to retain the connector module in connection with the audio device, and a release position, where the latch is not configured to retain the connector module in connection with the audio device;

an actuator moveably engaged with the connector module and being moveable with respect to the connector module between a first position and a second position that is shifted from the first position, wherein the actuator has an engagement surface configured to engage the latch to move the latch to the release position when the actuator is moved to the second position; and a biasing member engaging the actuator to bias the actuator away from the second position and toward the first position, wherein the actuator further has a second locking structure, and the actuator is further moveable between a free position, where the second locking structure does not engage the first locking structure of the connector module and the actuator is moveable between the first and second positions, and a locked position, where the second locking structure engages the first locking structure of the connector module and resists movement of the actuator toward the second position.

2. The connection assembly of claim 1, wherein the connector module further comprises an electronic component in communication with the connector, wherein the casing supports the electronic component.

3. The connection assembly of claim 1, wherein the first locking structure and the second locking structure have complementary inclined surfaces.

4. The connection assembly of claim 1, wherein the first locking structure comprises a first threaded portion and the second locking structure comprises a second threaded portion that is configured to engage the first threaded portion when the actuator is in the locked position.

5. The connection assembly of claim 1, wherein the biasing member comprises a spring engaging the actuator to bias the actuator toward the first position.

6. The connection assembly of claim 1, wherein engagement between the first and second locking structures during movement of the actuator from the free position to the locked position is configured to move the actuator axially toward the connector of the connector module.

7. The connection assembly of claim 1, wherein the actuator is configured for rotation in a first rotational direction to move from the free position to the locked position and a second rotational direction opposite to the first rotational direction to move from the locked position to the free position, wherein the actuator has a wall extending from a bottom end, and the connector module has a protrusion, and wherein when the actuator is in the free position, the wall is configured to abut the protrusion to resist rotation of the actuator in the second rotational direction.

8. The connection assembly of claim 1, wherein the actuator comprises a collar having a central passage defined by an inner surface, wherein the connector module extends through the central passage.

9. The connection assembly of claim 1, further comprising a housing having a cavity with an opening, where the connector module extends into the opening and a first portion of the connector module is received in the cavity, and where the actuator is moveably received within the cavity of the housing.

10. A connection assembly configured for connection to an audio device, comprising:

a connector module including a connector configured for electronic connection to a mating connector of the audio device and a casing supporting the connector;

a latch moveable between a latched position, where the latch is configured to engage the audio device and the connector module to retain the connector module in connection with the audio device, and a release position, where the latch is not configured to retain the connector module in connection with the audio device; and an actuator moveably engaged with the connector module and being moveable with respect to the connector module between a first position and a second position that is shifted from the first position, wherein the actuator has an engagement surface configured to engage the latch to move the latch to the release position when the actuator is moved to the second position, wherein the actuator is further moveable from the first position to a securing position, where the actuator is configured to be moved into closer engagement with the audio device to secure a connection between the connector module and the audio device.

11. The connection assembly of claim 10, wherein the connector module further comprises an electronic component in communication with the connector, wherein the casing supports the electronic component.

12. The connection assembly of claim 10, wherein when the actuator is in the securing position, the actuator engages a first locking structure to resist movement of the actuator to the second position.

13. The connection assembly of claim 12, wherein the first locking structure comprises a first threaded portion, and the actuator has a second threaded portion configured to engage the first threaded portion when the actuator is in the securing position.

14. The connection assembly of claim 12, wherein engagement of the actuator with the first locking structure is configured to move the actuator to the securing position by moving the actuator toward the connector of the connector module.

15. The connection assembly of claim 10, further comprising a biasing member engaging the actuator to bias the actuator toward the first position.

16. The connection assembly of claim 10, wherein the actuator comprises a collar having a central passage defined by an inner surface, wherein the connector module extends through the central passage.

17. The connection assembly of claim 10, further comprising a housing having a cavity with an opening, where the connector module extends into the opening and a first portion of the connector module is received in the cavity, and where the actuator is moveably received within the cavity of the housing.

18. A connection assembly configured for connection to an audio device, comprising:

a connector module including a connector configured for electronic connection to a mating connector of the audio device and a casing supporting the connector;

a latch moveable between a latched position, where the latch is configured to engage the audio device and the connector module to retain the connector module in connection with the audio device, and a release position, where the latch is not configured to retain the connector module in connection with the audio device; and an actuator moveably engaged with the connector module and being moveable with respect to the connector module to engage the latch to move the latch to the release position, wherein the actuator is further moveable between a free position, where the actuator is moveable to engage the latch to move the latch to the release position, and a locked position, where the actuator engages a first locking structure to resist movement of the actuator to engage the latch, and wherein movement of the actuator from the free position to the locked position is further configured to cause the actuator to move into closer engagement with the audio device to secure a connection between the connector module and the audio device.

19. The connection assembly of claim 18, wherein the connector module further comprises an electronic component in communication with the connector, wherein the casing supports the electronic component.

20. The connection assembly of claim 18, wherein the first locking structure comprises a first threaded portion, and the actuator has a second threaded portion configured to engage the first threaded portion when the actuator is in the locked position.

21. The connection assembly of claim 18, wherein the actuator is moveable between the free position and the locked position by rotation, and engagement of the actuator with the first locking structure is configured to move the actuator toward the connector of the connector module.

22. The connection assembly of claim 18, wherein the actuator comprises a collar having a central passage defined by an inner surface, wherein the connector module extends through the central passage.

23. The connection assembly of claim 18, wherein the actuator is configured for rotation in a first rotational direction to move from the free position to the locked position and a second rotational direction opposite to the first rotational direction to move from the locked position to the free position, wherein the actuator has a wall extending from a bottom end, and the connector module has a protrusion, and wherein when the actuator is in the free position, the wall is configured to abut the protrusion to resist rotation of the actuator in the second rotational direction.

24. The connection assembly of claim 18, further comprising a housing having a cavity with an opening, where the connector module extends into the opening and a first portion of the connector module is received in the cavity, and where the actuator is moveably received within the cavity of the housing.

* * * * *